US011804103B2

(12) United States Patent
Huke et al.

(10) Patent No.: US 11,804,103 B2
(45) Date of Patent: Oct. 31, 2023

(54) AI PROCESS TO IDENTIFY USER BEHAVIOR AND ALLOW SYSTEM TO TRIGGER SPECIFIC ACTIONS

(71) Applicant: AdrenalineIP, Washington, DC (US)

(72) Inventors: Casey Alexander Huke, Washington, DC (US); John Cronin, Jericho, VT (US); Joseph W. Beyers, Saratoga, CA (US); Michael D'Andrea, Burlington, VT (US); Michael Baker, Georgie, VT (US)

(73) Assignee: AdrenalineIP, Washington, DC (US)

( * ) Notice: Subject to any disclaimer, the term of this patent is extended or adjusted under 35 U.S.C. 154(b) by 0 days.

(21) Appl. No.: 17/097,355

(22) Filed: Nov. 13, 2020

(65) Prior Publication Data

US 2022/0139156 A1 May 5, 2022

Related U.S. Application Data

(60) Provisional application No. 63/107,657, filed on Oct. 30, 2020.

(51) Int. Cl.
*G07F 17/32* (2006.01)

(52) U.S. Cl.
CPC ..... *G07F 17/326* (2013.01); *G07F 17/3288* (2013.01)

(58) Field of Classification Search
CPC ..... G07F 17/326; G07F 17/3288
USPC ..... 463/25
See application file for complete search history.

(56) References Cited

U.S. PATENT DOCUMENTS

| | | | | |
|---|---|---|---|---|
| 7,792,960 | B2 | 9/2010 | Goglin et al. | |
| 8,360,838 | B2 | 1/2013 | Nguyen et al. | |
| 8,961,289 | B2 | 2/2015 | Tsukahara | |
| 9,734,663 | B2 | 8/2017 | Chun et al. | |
| 2007/0243927 | A1* | 10/2007 | Soltys | G07F 17/32 463/25 |
| 2009/0070081 | A1* | 3/2009 | Saenz | G07F 17/3227 703/2 |
| 2010/0179930 | A1* | 7/2010 | Teller | G06N 20/00 706/12 |
| 2011/0250972 | A1* | 10/2011 | Horbay | G07F 17/3237 463/42 |
| 2017/0294075 | A1* | 10/2017 | Frenkel | G07F 17/3246 |

OTHER PUBLICATIONS

International Search Report and Written Opinion dated Dec. 8, 2021 in corresponding International Application No. PCT/US2021/057277; 11 pages.

* cited by examiner

*Primary Examiner* — Jay Trent Liddle
*Assistant Examiner* — Ryan Hsu
(74) *Attorney, Agent, or Firm* — Maier & Maier, PLLC

(57) ABSTRACT

Described is a method of detecting the use of automation to place wagers on a play by play wagering platform by a user's account by identifying correlations within the user's historical wager data exceeding a threshold indicating that automation is being used to place wagers using the user's account an invalidating wagers placed by the user's account.

11 Claims, 3 Drawing Sheets

Base Wagering Module Object Content

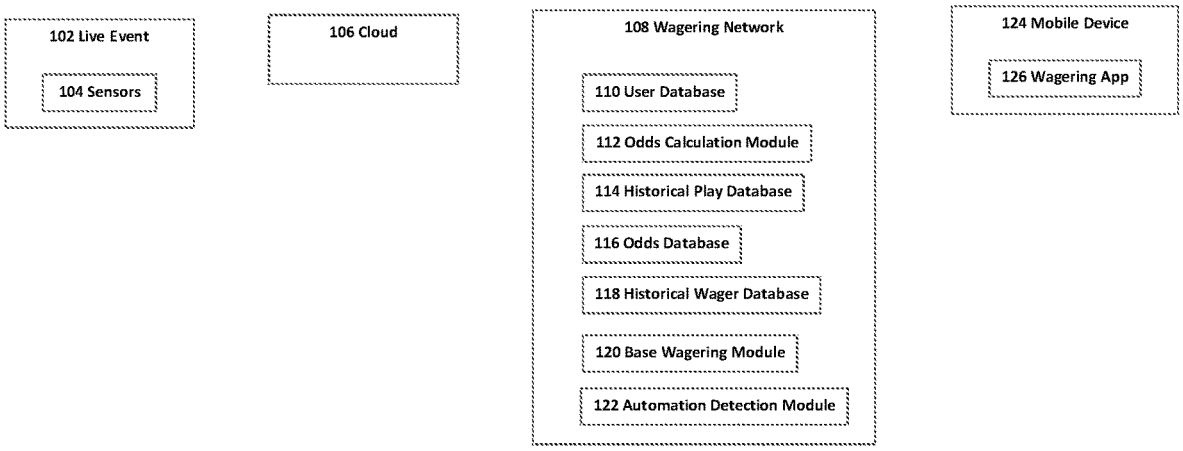

Fig.1 Content - High Level Diagram

| | | | Parameters | | | | | | | Context | | |
|---|---|---|---|---|---|---|---|---|---|---|---|---|
| User ID | Event ID | Play # | Wager Amount | Odds | Action | Outcome | Time to Place Wager (seconds) | Gain | Result | Quarter | Down | Distance |
| 3151 | 321 | 11 | $50.00 | 2/1 | Run | First down | 0.19 | 3 | Win | 2nd | Second | 10 |
| 3151 | 321 | 18 | $25.00 | 4/1 | Pass | First down | 0.18 | 15 | Loss | 2nd | First | 12 |
| 3151 | 351 | 6 | $75.00 | 2/1 | Pass | First down | 0.25 | 5 | Loss | 3rd | Third | 9 |
| 3151 | 365 | 3 | $50.00 | 2/1 | Pass | First down | 0.21 | 6 | Win | 1st | Second | 10 |
| 3151 | 365 | 7 | $50.00 | 2/1 | Run | First down | 0.20 | 4 | Win | 4th | Second | 7 |
| 3151 | 365 | 13 | $75.00 | 2/1 | Run | First down | 0.26 | 2 | Loss | 3rd | Third | 8 |
| 3151 | 501 | 2 | $25.00 | 5/1 | Run | First down | 0.17 | 8 | Loss | 3rd | First | 4 |
| 3151 | 501 | 5 | $50.00 | 2/1 | Run | First down | 0.21 | -2 | Win | 2nd | Second | 10 |
| 3151 | 501 | 8 | $75.00 | 2/1 | Pass | First down | 0.25 | 4 | Win | 3rd | Third | 5 |
| 3151 | 501 | 14 | $25.00 | 4/1 | Run | First down | 0.18 | 6 | Win | 1st | First | 2 |
| ... | ... | ... | ... | ... | ... | ... | ... | ... | ... | ... | ... | ... |
| ... | ... | ... | ... | ... | ... | ... | ... | ... | ... | ... | ... | ... |
| ... | ... | ... | ... | ... | ... | ... | ... | ... | ... | ... | ... | ... |

Fig.2 Historical Wager Database Data Content

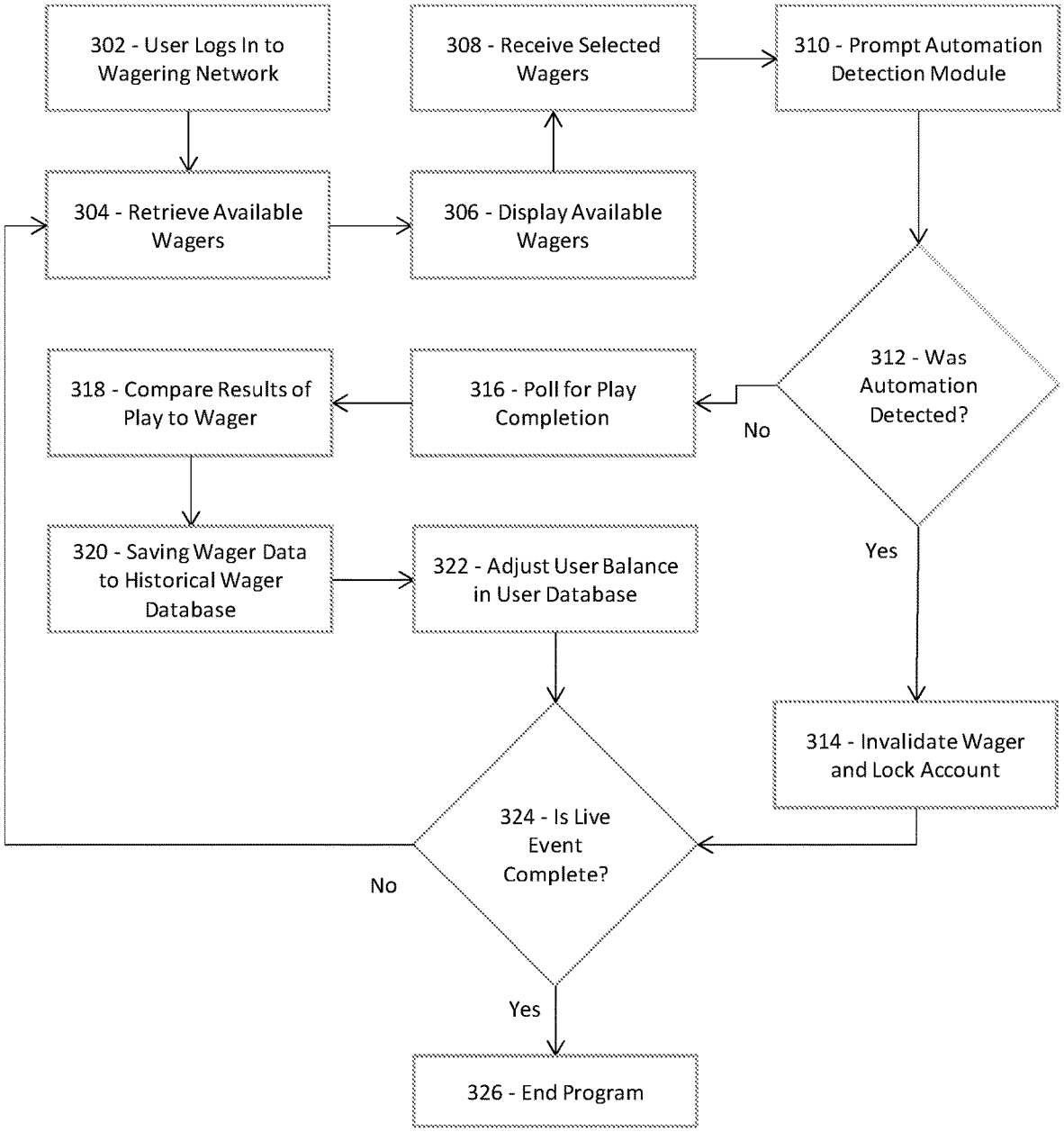
Fig.3 Base Wagering Module Object Content

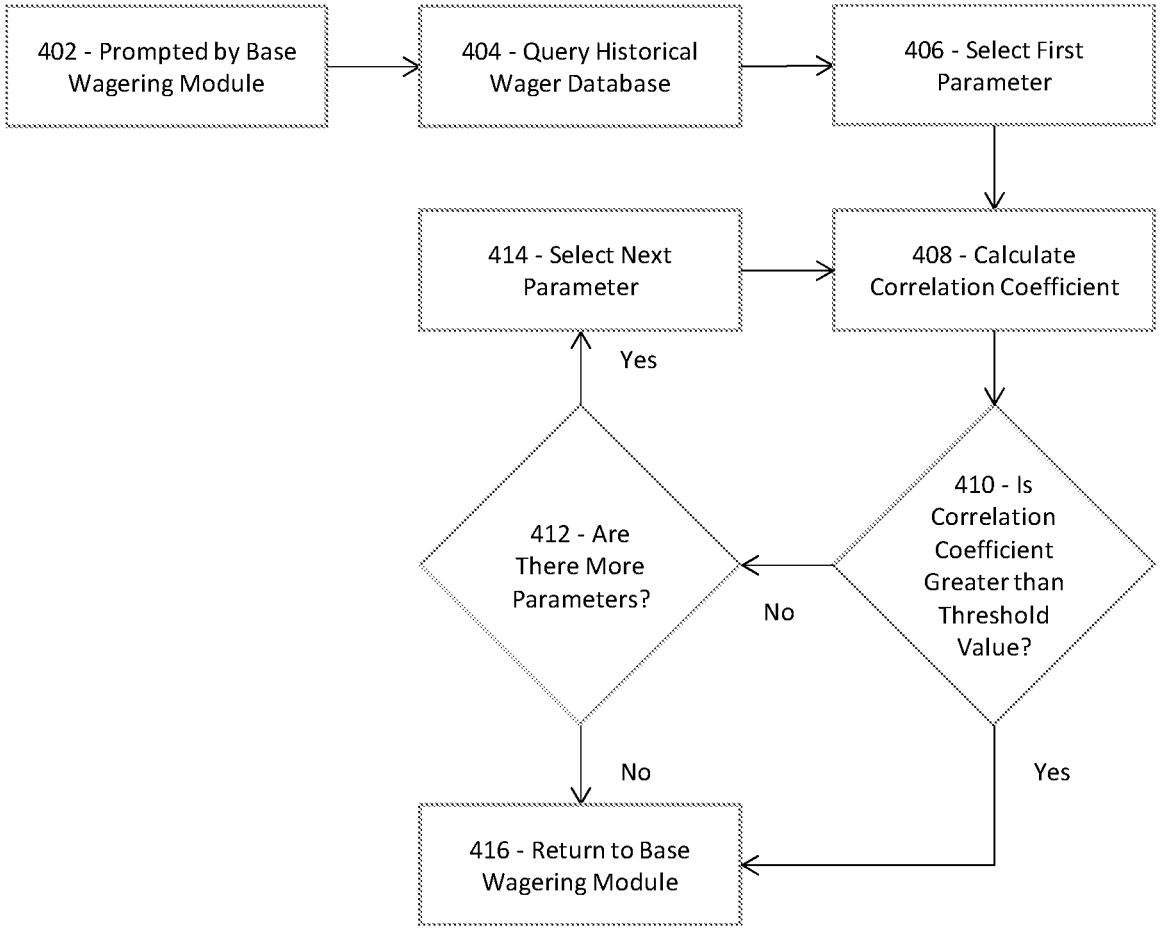
Fig.4 Automation Detection Module Object Content

AI PROCESS TO IDENTIFY USER BEHAVIOR AND ALLOW SYSTEM TO TRIGGER SPECIFIC ACTIONS

FIELD

The embodiments are generally related to wagering on live sporting events, specifically detecting automated wagers on a play by play wagering system.

BACKGROUND

A wagering network is intended to provide users the opportunity to place wagers during a live event, however the use of automation may provide the user an unacceptable advantage. Unfortunately, detecting the use of automation can be difficult and the operator of a wagering network may suffer losses as a result.

Cybersecurity is a constant consideration and challenge for anyone operating a software service. Accounts can be highjacked by autonomous bots and used to earn illicit gains or cause harm to users or the operators of a service. This could cause considerable harm to the reputation of a wagering network operator and result in considerable losses.

Fake accounts created and managed by bots could place high frequency wagers based on data models to optimize winnings. This could disadvantage the operator of a wagering network resulting in significant losses. While the use of such bots might be violations of a wagering network's terms of service, identifying the activity of these bots and intervening can be difficult.

BRIEF DESCRIPTIONS OF THE DRAWINGS

The accompanying drawings illustrate various embodiments of systems, methods, and various other aspects of the embodiments. Any person with ordinary skills in the art will appreciate that the illustrated element boundaries (e.g. boxes, groups of boxes, or other shapes) in the figures represent an example of the boundaries. It may be understood that, in some examples, one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

FIG. 1 illustrates an automated wager detection, according to an embodiment.

FIG. 2 illustrates a historical wager database, according to an embodiment.

FIG. 3 illustrates a base wagering module, according to an embodiment.

FIG. 4 illustrates an automation detection module, according to an embodiment.

DETAILED DESCRIPTION

Aspects of the present invention are disclosed in the following description and related figures directed to specific embodiments of the invention. Those of ordinary skill in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word exemplary means serving as an example, instance or illustration. The embodiments described herein are not limiting, but rather are exemplary only. It should be understood that the described embodiments are not necessarily to be construed as preferred or advantageous over other embodiments. Moreover, the terms embodiments of the invention, embodiments or invention do not require that all embodiments of the invention include the discussed feature, advantage, or mode of operation.

Further, many of the embodiments described herein are described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, a computer configured to perform the described action.

With respect to the embodiments, a summary of terminology used herein is provided.

An action refers to a specific play or specific movement in a sporting event. For example, an action may determine which players were involved during a sporting event. In some embodiments, an action may be a throw, shot, pass, swing, kick, hit, performed by a participant in a sporting event. In some embodiments, an action may be a strategic decision made by a participant in the sporting event such as a player, coach, management, etc. In some embodiments, an action may be a penalty, foul, or type of infraction occurring in a sporting event. In some embodiments, an action may include the participants of the sporting event. In some embodiments, an action may include beginning events of sporting event, for example opening tips, coin flips, opening pitch, national anthem singers, etc. In some embodiments, a sporting event may be football, hockey, basketball, baseball, golf, tennis, soccer, cricket, rugby, MMA, boxing, swimming, skiing, snowboarding, horse racing, car racing, boat racing, cycling, wrestling, Olympic sport, eSports, etc. Actions can be integrated into the embodiments in a variety of manners.

A "bet" or "wager" is to risk something, usually a sum of money, against someone else's or an entity on the basis of the outcome of a future event, such as the results of a game or event. It may be understood that non-monetary items may be the subject of a "bet" or "wager" as well, such as points or anything else that can be quantified for a "bet" or "wager". A bettor refers to a person who bets or wagers. A bettor may also be referred to as a user, client, or participant throughout the present invention. A "bet" or "wager" could be made for obtaining or risking a coupon or some enhancements to the sporting event, such as better seats, VIP treatment, etc. A "bet" or "wager" can be done for certain amount or for a future time. A "bet" or "wager" can be done for being able to answer a question correctly. A "bet" or "wager" can be done within a certain period of time. A "bet" or "wager" can be integrated into the embodiments in a variety of manners.

A "book" or "sportsbook" refers to a physical establishment that accepts bets on the outcome of sporting events. A "book" or "sportsbook" system enables a human working with a computer to interact, according to set of both implicit and explicit rules, in an electronically powered domain for the purpose of placing bets on the outcome of sporting event. An added game refers to an event not part of the typical menu of wagering offerings, often posted as an accommodation to patrons. A "book" or "sportsbook" can be integrated into the embodiments in a variety of manners.

To "buy points" means a player pays an additional price (more money) to receive a half-point or more in the player's favor on a point spread game. Buying points means you can move a point spread, for example up to two points in your favor. "Buy points" can be integrated into the embodiments in a variety of manners.

The "price" refers to the odds or point spread of an event. To "take the price" means betting the underdog and receiving its advantage in the point spread. "Price" can be integrated into the embodiments in a variety of manners.

"No action" means a wager in which no money is lost or won, and the original bet amount is refunded. "No action" can be integrated into the embodiments in a variety of manners.

The "sides" are the two teams or individuals participating in an event: the underdog and the favorite. The term "favorite" refers to the team considered most likely to win an event or game. The "chalk" refers to a favorite, usually a heavy favorite. Bettors who like to bet big favorites are referred to "chalk eaters" (often a derogatory term). An event or game in which the sports book has reduced its betting limits, usually because of weather or the uncertain status of injured players is referred to as a "circled game." "Laying the points or price" means betting the favorite by giving up points. The term "dog" or "underdog" refers to the team perceived to be most likely to lose an event or game. A "longshot" also refers to a team perceived to be unlikely to win an event or game. "Sides", "favorite", "chalk", "circled game", "laying the points price", "dog" and "underdog" can be integrated into the embodiments in a variety of manners.

The "money line" refers to the odds expressed in terms of money. With money odds, whenever there is a minus (−) the player "lays" or is "laying" that amount to win (for example $100); where there is a plus (+) the player wins that amount for every $100 wagered. A "straight bet" refers to an individual wager on a game or event that will be determined by a point spread or money line. The term "straight-up" means winning the game without any regard to the "point spread"; a "money-line" bet. "Money line", "straight bet", "straight-up" can be integrated into the embodiments in a variety of manners.

The "line" refers to the current odds or point spread on a particular event or game. The "point spread" refers to the margin of points in which the favored team must win an event by to "cover the spread." To "cover" means winning by more than the "point spread". A handicap of the "point spread" value is given to the favorite team so bettors can choose sides at equal odds. "Cover the spread" means that a favorite win an event with the handicap considered or the underdog wins with additional points. To "push" refers to when the event or game ends with no winner or loser for wagering purposes, a tie for wagering purposes. A "tie" is a wager in which no money is lost or won because the teams' scores were equal to the number of points in the given "point spread". The "opening line" means the earliest line posted for a particular sporting event or game. The term "pick" or "pick'em" refers to a game when neither team is favored in an event or game. "Line", "cover the spread", "cover", "tie", "pick" and "pick-em" can be integrated into the embodiments in a variety of manners.

To "middle" means to win both sides of a game; wagering on the "underdog" at one point spread and the favorite at a different point spread and winning both sides. For example, if the player bets the underdog +4½ and the favorite −3½ and the favorite wins by 4, the player has middled the book and won both bets. "Middle" can be integrated into the embodiments in a variety of manners.

Digital gaming refers to any type of electronic environment that can be controlled or manipulated by a human user for entertainment purposes. A system that enables a human and a computer to interact according to set of both implicit and explicit rules, in an electronically powered domain for the purpose of recreation or instruction. "eSports" refers to a form of sports competition using video games, or a multiplayer video game played competitively for spectators, typically by professional gamers. Digital gaming and "eSports" can be integrated into the embodiments in a variety of manners.

The term event refers to a form of play, sport, contest, or game, especially one played according to rules and decided by skill, strength, or luck. In some embodiments, an event may be football, hockey, basketball, baseball, golf, tennis, soccer, cricket, rugby, MMA, boxing, swimming, skiing, snowboarding, horse racing, car racing, boat racing, cycling, wrestling, Olympic sport, etc. Event can be integrated into the embodiments in a variety of manners.

The "total" is the combined number of runs, points or goals scored by both teams during the game, including overtime. The "over" refers to a sports bet in which the player wagers that the combined point total of two teams will be more than a specified total. The "under" refers to bets that the total points scored by two teams will be less than a certain figure. "Total", "over", and "under" can be integrated into the embodiments in a variety of manners.

A "parlay" is a single bet that links together two or more wagers; to win the bet, the player must win all the wagers in the "parlay". If the player loses one wager, the player loses the entire bet. However, if he wins all the wagers in the "parlay", the player wins a higher payoff than if the player had placed the bets separately. A "round robin" is a series of parlays. A "teaser" is a type of parlay in which the point spread, or total of each individual play is adjusted. The price of moving the point spread (teasing) is lower payoff odds on winning wagers. "Parlay", "round robin", "teaser" can be integrated into the embodiments in a variety of manners.

A "prop bet" or "proposition bet" means a bet that focuses on the outcome of events within a given game. Props are often offered on marquee games of great interest. These include Sunday and Monday night pro football games, various high-profile college football games, major college bowl games and playoff and championship games. An example of a prop bet is "Which team will score the first touchdown?" "Prop bet" or "proposition bet" can be integrated into the embodiments in a variety of manners.

A "first-half bet" refers to a bet placed on the score in the first half of the event only and only considers the first half of the game or event. The process in which you go about placing this bet is the same process that you would use to place a full game bet, but as previously mentioned, only the first half is important to a first-half bet type of wager. A "half-time bet" refers to a bet placed on scoring in the second half of a game or event only. "First-half-bet" and "half-time-bet" can be integrated into the embodiments in a variety of manners.

A "futures bet" or "future" refers to the odds that are posted well in advance on the winner of major events, typical future bets are the Pro Football Championship, Collegiate Football Championship, the Pro Basketball Championship, the Collegiate Basketball Championship, and the Pro Baseball Championship. "Futures bet" or "future" can be integrated into the embodiments in a variety of manners.

The "listed pitchers" is specific to a baseball bet placed only if both of the pitchers scheduled to start a game actually start. If they don't, the bet is deemed "no action" and refunded. The "run line" in baseball, refers to a spread used instead of the money line. "Listed pitchers" and "no action" and "run line" can be integrated into the embodiments in a variety of manners.

The term "handle" refers to the total amount of bets taken. The term "hold" refers to the percentage the house wins. The term "juice" refers to the bookmaker's commission, most commonly the 11 to 10 bettors lay on straight point spread wagers: also known as "vigorish" or "vig". The "limit" refers to the maximum amount accepted by the house before the odds and/or point spread are changed. "Off the board" refers to a game in which no bets are being accepted. "Handle", "juice", vigorish", "vig" and "off the board" can be integrated into the embodiments in a variety of manners.

"Casinos" are a public room or building where gambling games are played. "Racino" is a building complex or grounds having a racetrack and gambling facilities for playing slot machines, blackjack, roulette, etc. "Casino" and "Racino" can be integrated into the embodiments in a variety of manners.

Customers are companies, organizations or individual that would deploy, for fees, and may be part of, or perform, various system elements or method steps in the embodiments.

Managed service user interface service is a service that can help customers (1) manage third parties, (2) develop the web, (3) do data analytics, (4) connect thru application program interfaces and (4) track and report on player behaviors. A managed service user interface can be integrated into the embodiments in a variety of manners.

Managed service risk management services are services that assists customers with (1) very important person management, (2) business intelligence, and (3) reporting. These managed service risk management services can be integrated into the embodiments in a variety of manners.

Managed service compliance service is a service that helps customers manage (1) integrity monitoring, (2) play safety, (3) responsible gambling and (4) customer service assistance. These managed service compliance services can be integrated into the embodiments in a variety of manners.

Managed service pricing and trading service is a service that helps customers with (1) official data feeds, (2) data visualization and (3) land based, on property digital signage. These managed service pricing and trading services can be integrated into the embodiments in a variety of manners.

Managed service and technology platform are services that helps customers with (1) web hosting, (2) IT support and (3) player account platform support. These managed service and technology platform services can be integrated into the embodiments in a variety of manners.

Managed service and marketing support services are services that help customers (1) acquire and retain clients and users, (2) provide for bonusing options and (3) develop press release content generation. These managed service and marketing support services can be integrated into the embodiments in a variety of manners.

Payment processing services are those services that help customers that allow for (1) account auditing and (2) withdrawal processing to meet standards for speed and accuracy. Further, these services can provide for integration of global and local payment methods. These payment processing services can be integrated into the embodiments in a variety of manners.

Engaging promotions allow customers to treat your players to free bets, odds boosts, enhanced access and flexible cashback to boost lifetime value. Engaging promotions can be integrated into the embodiments in a variety of manners.

"Cash out" or "pay out" or "payout" allow customers to make available, on singles bets or accumulated bets with a partial cash out where each operator can control payouts by managing commission and availability at all times. The "cash out" or "pay out" or "payout" can be integrated into the embodiments in a variety of manners, including both monetary and non-monetary payouts, such as points, prizes, promotional or discount codes, and the like.

"Customized betting" allow customers to have tailored personalized betting experiences with sophisticated tracking and analysis of players' behavior. "Customized betting" can be integrated into the embodiments in a variety of manners.

Kiosks are devices that offer interactions with customers clients and users with a wide range of modular solutions for both retail and online sports gaming. Kiosks can be integrated into the embodiments in a variety of manners.

Business Applications are an integrated suite of tools for customers to manage the everyday activities that drive sales, profit, and growth, by creating and delivering actionable insights on performance to help customers to manage the sports gaming. Business Applications can be integrated into the embodiments in a variety of manners.

State based integration allows for a given sports gambling game to be modified by states in the United States or other countries, based upon the state the player is in, based upon mobile phone or other geolocation identification means. State based integration can be integrated into the embodiments in a variety of manners.

Game Configurator allow for configuration of customer operators to have the opportunity to apply various chosen or newly created business rules on the game as well as to parametrize risk management. Game configurator can be integrated into the embodiments in a variety of manners.

"Fantasy sports connector" are software connectors between method steps or system elements in the embodiments that can integrate fantasy sports. Fantasy sports allow a competition in which participants select imaginary teams from among the players in a league and score points according to the actual performance of their players. For example, if a player in a fantasy sports is playing at a given real time sports, odds could be changed in the real time sports for that player.

Software as a service (or SaaS) is a method of software delivery and licensing in which software is accessed online via a subscription, rather than bought and installed on individual computers. Software as a service can be integrated into the embodiments in a variety of manners.

Synchronization of screens means synchronizing bets and results between devices, such as TV and mobile, PC and wearables. Synchronization of screens can be integrated into the embodiments in a variety of manners.

Automatic content recognition (ACR) is an identification technology to recognize content played on a media device or present in a media file. Devices containing ACR support enable users to quickly obtain additional information about the content they see without any user-based input or search efforts. To start the recognition, a short media clip (audio, video, or both) is selected. This clip could be selected from within a media file or recorded by a device. Through algorithms such as fingerprinting, information from the actual perceptual content is taken and compared to a database of reference fingerprints, each reference fingerprint corresponding to a known recorded work. A database may contain metadata about the work and associated information, including complementary media. If the fingerprint of the media clip is matched, the identification software returns the corresponding metadata to the client application. For example, during an in-play sports game a "fumble" could be recognized and at the time stamp of the event, metadata such as "fumble" could be displayed. Automatic content recognition (ACR) can be integrated into the embodiments in a variety of manners.

Joining social media means connecting an in-play sports game bet or result to a social media connection, such as a FACEBOOK® chat interaction. Joining social media can be integrated into the embodiments in a variety of manners.

Augmented reality means a technology that superimposes a computer-generated image on a user's view of the real world, thus providing a composite view. In an example of this invention, a real time view of the game can be seen and a "bet" which is a computer-generated data point is placed above the player that is bet on. Augmented reality can be integrated into the embodiments in a variety of manners.

Some embodiments of this disclosure, illustrating all its features, will now be discussed in detail. It can be understood that the embodiments are intended to be open ended in that an item or items used in the embodiments is not meant to be an exhaustive listing of such item or items, or meant to be limited to only the listed item or items.

It can be noted that as used herein and in the appended claims, the singular forms "a," "an," and "the" include plural references unless the context clearly dictates otherwise. Although any systems and methods similar or equivalent to those described herein can be used in the practice or testing of embodiments, only some exemplary systems and methods are now described.

FIG. 1 is a system for automated wager detection. This system is comprised of a live event 102, for example a sporting event such as a football game, basketball game, baseball game, hockey game, tennis match, golf tournament, eSports or digital game, etc. The live event 102 will include some number of actions or plays, upon which a user or bettor or customer can place a bet or wager, typically through an entity called a sportsbook. There are numerous types of wagers the bettor can make, including, a straight bet, a money line bet, a bet with a point spread or line that bettor's team would need to cover, if the result of the game was the same as the point spread the user would not cover the spread, but instead the tie is called a push. If the user is betting on the favorite, they are giving points to the opposing side, which is the underdog or longshot. Betting on all favorites is referred to as chalk, this is typically applied to round robin, or other styles of tournaments. There are other types of wagers, including parlays, teasers, and prop bets, that are added games, that often allow the user to customize their betting, by changing the odds and payouts they receive on a wager. Certain sportsbooks will allow the bettor to buy points, to move the point spread off of the opening line, this will increase the price of the bet, sometimes by increasing the juice, vig, or hold that the sportsbook takes. Another type of wager the bettor can make is an over/under, in which the user bets over or under a total for the live event 102, such as the score of American football or the run line in baseball, or a series of action in the live event 102. Sportsbooks have a number of bets they can handle and a limit of wagers they can take on either side of a bet before they will move the line or odds off of the opening line. Additionally, there are circumstance, such as an injury to an important player such as a listed pitcher, in which a sportsbook, casino or racino will take an available wager off the board. As the line moves there becomes an opportunity for a bettor to bet on both sides at different point spreads in order to middle and win both bets. Sportsbooks will often offer bets on portions of games, such as first half bets and half-time bets. Additionally, the sportsbook can offer futures bets on live events 102 in the future. Sportsbooks need to offer payment processing services in order to cash out customers. This can be done at kiosks at the live event 102 or at another location.

Further, embodiments may include a plurality of sensors 104 that may be used such as motion sensors, temperature sensors, humidity sensors, cameras such as an RGB-D Camera which is a digital camera capturing color (RGB) and depth information for every pixel in an image, microphones, a radiofrequency receiver, a thermal imager, a radar device, a lidar device, an ultrasound device, a speaker, wearable devices etc. Also, the plurality of sensors 104 may include tracking devices, such as RFID tags, GPS chips or other such devices embedded on uniforms, in equipment, in the field of play, in the boundaries of the field of play, or other markers on the field of play. Imaging devices may also be used as tracking devices such as player tracking that captures statistical information through real-time X, Y positioning of players and X, Y, Z positioning of the ball.

Further, embodiments may include a cloud 106 or communication network which may be a wired and/or a wireless network. The communication network, if wireless, may be implemented using communication techniques such as Visible Light Communication (VLC), Worldwide Interoperability for Microwave Access (WiMAX), Long Term Evolution (LTE), Wireless Local Area Network (WLAN), Infrared (IR) communication, Public Switched Telephone Network (PSTN), Radio waves, and other communication techniques known in the art. The communication network may allow ubiquitous access to shared pools of configurable system resources and higher-level services that can be rapidly provisioned with minimal management effort, which may occur over Internet and relies on sharing of resources to achieve coherence and economies of scale, like a public utility, while third-party clouds enable organizations to focus on their core businesses instead of expending resources on computer infrastructure and maintenance. The cloud 106 may be communicatively coupled to a wagering network 108 which may perform real time analysis on the type of play and the result of the play. The cloud 106 may also be synchronized with game situational data, such as the time of the game, the score, location on the field, weather conditions, and the like which may affect the choice of play utilized. For example, in an exemplary embodiment, the cloud may not receive data gathered from sensors 104 and may, instead, receive data from an alternative data feed, such as SportsRadar®. This data may be provided substantially immediately following the completion of any play and the data from this feed may be compared with a variety of team data and league data based on a variety of elements, including down, possession, score, time, team, and so forth, as described in various exemplary embodiments herein.

Further, embodiments may include the wagering network 108 which may perform real time analysis on the type of play and the result of a play or action. The wagering network 108 (or cloud 106) may also be synchronized with game situational data, such as the time of the game, the score, location on the field, weather conditions, and the like which may affect the choice of play utilized. For example, in an exemplary embodiment, a wagering network 108 may not receive data gathered from sensors 104 and may, instead, receive data from an alternative data feed, such as SportsRadar®. This data may be provided substantially immediately following the completion of any play and the data from this feed may be compared with a variety of team data and league data based on a variety of elements, including down, possession, score, time, team, and so forth, as described in various exemplary embodiments herein. The wagering network 108 may offer any of a number of different software as a managed service such as, user interface service, risk management service, compliance, pricing and trading service, IT support of the technology platform, business applications, game configuration, state based integration, fantasy sports connection, integration to allow the joining of social media, and marketing support services that can deliver engaging promotions to the user.

Further, embodiments may utilize a user database 110 which contains data relevant to all users of the system, which may include, a user ID, a device identifier, a paired device identifier, wagering history, and wallet information for each user.

Further, embodiments may include an odds calculation module 112 which utilizes historical play data to calculate odds for in-play wagers.

Further, embodiments may include a historical play database 114, that contains play data for the type of sport being played in the live event 102. For example, in American Football, for optimal odds calculation, the historical play data should include meta data about the historical plays, such as time, location, weather, previous plays, opponent, physiological data, etc.

Further, embodiments may utilize an odds database 116 that contains the odds calculated by the odds calculation module 112, and multipliers for distance and path deviation, and is used for reference by a base wagering module 120 and to take bets from the user through a user interface and calculate the payouts to the user.

Further, embodiments may utilize a historical wager database 118 that contains wagers from live events 102. Wagers may include a wager amount, odds, and an outcome such that a payout in the amount of the wager amount multiplied by the odds will be paid to a user if the outcome wagered on occurs, otherwise the wager amount being lost. The historical wager database 118 may additionally contain contextual data about the state of a live event 102 when the wager was placed.

Further, embodiments may include the base wagering module 120 which allows a user to log into the wagering network 108, retrieves available wagers from the odds database 116 and displays available wagers to a user. The base wagering module 120 prompts an automation detection module 122 which returns whether automation was detected in the placing of the received wager. The automation detection module 122 invalidates the received wager if automation is detected. If automation is not detected, automation detection module 122 polls for play completion, and compares the results of the play to the wager. automation detection module 122 saves the results of the wager to the historical wager database 118 and adjusts the user's balance in the user database 110 based on the results of the wager. automation detection module 122 checks whether the live event 102 is complete and ends the program if the live event 102 is complete.

Further, embodiments may include the automation detection module 122 which receives a prompt with a wager from the base wagering module 120 and contextual information about a live event 102 from sensors 104. The automation detection module 122 queries the historical wager database 122 for a user's past wagers and filters the past wagers by contextual information about the live event 102 and selects a parameter. The automation detection module 122 calculates correlation coefficients for pairings of the selected parameter with each parameter not selected and compares the correlation coefficients to a threshold value. If a correlation coefficient is greater than the threshold value, the automation detection module 122 returns to the base wagering module 120 that automation has been detected, otherwise it continues checking whether there are additional parameters which have not been evaluated for correlation, selects one of the parameters, and repeats the steps of calculating and comparing correlation coefficients to a threshold value. If none of the correlation coefficients are greater than the threshold value and there are no remaining parameters to evaluate for correlation, the automation detection module 122 returns to the base wagering module 120 that automation was not detected.

Further, embodiments may include a mobile device 124 such as a computing device, laptop, smartphone, tablet, computer, smart speaker, or I/O devices. I/O devices may be present in the computing device. Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, and 3D printers. Devices may include a combination of multiple input or output devices, including, e.g., Microsoft KINECT, Nintendo Wii mote for the WIT, Nintendo WII U GAMEPAD, or Apple IPHONE. Some devices allow gesture recognition inputs through combining some of the inputs and outputs. Some devices allow for facial recognition which may be utilized as an input for different purposes including authentication and other commands. Some devices provide for voice recognition and inputs, including, e.g., Microsoft KINECT, SIRI for IPHONE by Apple, Google Now or Google Voice Search. Additional user devices have both input and output capabilities, including, e.g., haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures. Some touchscreen devices, including, e.g., Microsoft PIXELSENSE or Multi-Touch Collaboration Wall, may have larger surfaces, such as on a table-top or on a wall, and may also interact with other electronic devices. Some I/O devices, display devices or group of devices may be augmented reality devices. The I/O devices may be controlled by an I/O controller. The I/O controller may control one or more I/O devices, such as, e.g., a keyboard and a pointing device, a mouse or optical pen. Furthermore, an I/O device may also contain storage and/or an installation medium for the computing device. In still other embodiments, the computing device may include USB connections (not shown) to receive handheld USB storage devices. In further embodiments, an I/O device may be a bridge between the system bus and an external communication bus, e.g. a USB bus, a SCSI bus, a FireWire bus, an Ethernet bus, a Gigabit Ethernet bus, a Fiber Channel bus, or a Thunderbolt bus. In some embodiments the mobile device 124 could be an optional component and would be utilized in a situation in which a paired wearable device is utilizing the mobile device 124 as additional memory or computing power or connection to the internet.

Further, embodiments may include a wagering app 126, which is a program that enables the user to place bets on individual plays in the live event 102, and display the audio and video from the live event 102, along with the available wagers on the mobile device 124. The wagering app 126 allows the user to interact with the wagering network 108 in order to place bets and provide payment/receive funds based on wager outcomes.

FIG. 2 illustrates the historical wager database 118. The historical wager database 118 stores data about wagers placed by users during a live event 102 including prior events. The data may include any of a user ID, wager amount, odds, and outcome. The user ID identifies the user of a wagering network 108 who placed the wager, a wager amount is a monetary value wagered by the user and the odds are the multiple by which the wager amount will be increased to calculate a payout if the wager is won. A wager is won if the outcome, the result of a play wagered upon by the user, occurs. The historical wager database 118 may further include situational context about the live event 102 when the wager was placed. In an American football game, the situation context data may include the quarter, down and distance to first down or goal. The historical wager database 118 is populated by the base wagering module 120 and is used by the automation detection module 122 to calculate the correlation coefficient for parameters of a user's past and present wagers to be compared against a threshold value such that a correlation coefficient greater than the threshold value indicates automation was used to place a wager.

FIG. 3 illustrates the base wagering module 120. The process begins with a user logging into, at step 302, the wagering network 108 via a user interface by entering a username and a password. In an embodiment, the username is an email address and the password is a combination of alphanumeric characters. The base wagering module 120 retrieves, at step 304, the currently available wagers from the odds database 116. The wagers include an outcome and odds such that the outcome is the condition which must be met during the play to win the wager and the odds represent the multiple by which the wager amount placed by a user will be multiplied to determine the payout due to the user if the wager is won. The base wagering module 120 displays, at step 306, the available wagers to a user via a wagering app 126 on a mobile device 124. The wagers including an outcome and odds. The wagers may additionally include a default wager amount. The base wagering module 120 receives, at step 308, at least one wager from a user from the available wagers. The wager includes a wager amount, outcome and odds. In an American football game between the New England Patriots and the New York Giants, user Joe Smith wagers $50 at odds of 5/1 that the New England Patriots will convert a second and 8 for a first down with 5 minutes remaining in the third quarter. The wager is placed 0.21 seconds after the available wagers were displayed to the user Joe Smith. The base wagering module 120 prompts, at step 310, the automation detection module 122 with the wager received from a user. The automation detection module 122 additionally receives contextual data about the live event 102 from sensors 104 and queries the historical wager database 118 for the user's past wagers. The automation detection module 122 filters the user's past wagers for contextual information, such as the current state of the live event 102 and selects a parameter. The automation detection module 122 calculates correlation coefficients for each pairing of the selected parameter with each other parameter not selected and compares the correlation coefficients to a threshold value. The automation detection module 122 determines that automation was used to place wagers if a correlation coefficient exceeds the threshold value. If none of the correlation coefficients exceed the threshold value, the automation detection module 122 selects another parameter if there are more that have not been evaluated for correlation, and repeats the steps of calculating correlation coefficients and comparing the correlation coefficients to the threshold value. The automation detection module 122 determines that automation was not used to place wagers if no correlation coefficients exceed the threshold value and there are no more parameters which have not been evaluated for correlation. The automation detection module 122 returns the determination of whether automation was or was not detected to the base wagering module 120. The base wagering module 120 receives, at step 312, whether automation was detected from the automation detection module 122. In the example, the automation detection module 122 identifies that automation was used to place wagers. The base wagering module 120 invalidates, at step 314, the wager if automation is detected by the automation detection module 122 and further may lock the user's account. Having detected trends in historical data indicating a history of using automation to place wagers, the base wagering module 120 may prevent continued use of the detected automation by preventing the user's account from placing additional wagers. In the example, the user Joe Smith's account has been determined to be using automation to place wagers and therefore the current wager is deemed invalid and the wager amount debited from the user Joe Smith's account is refunded. The user Joe Smith's account is additionally locked, preventing additional wagers from being placed. A notification may further be provided to user Joe Smith that the wager was invalidated and the account locked. The account may be locked for a duration which may be defined by the administrator of the wagering network 108 or alternatively require the user to take an action to unlock the account to confirm that they are a human. The base wagering module 120 polls, at step 316, the sensors 104 for play completion. Completion of the play indicates that result of the play can be acquired and compared to the outcome wagered on by the user. In the example, the play is complete when at least one referee blows their whistle when a player carrying the ball for a run for the New England Patriots runs out of bounds. The base wagering module 120 compares, at step 318, the results of the play to the outcome wagered on by the user. The wager is won if the results of the play match the outcome wagered on by the user, while the wager is lost if the results of the play and the outcome wagered on by the user are different. In the example, the play resulted in a gain of 3 yards on a run for the New England Patriots resulting in third down and 5 yards to a first down. The user Joe Smith, having wagered $50 at 5/1 odds that the Patriots would convert second down and 8 yards for a first down, lost the wager as the Patriots did not convert for a first down during the play. The base wagering module 120 saves, at step 320, wager data to the historical wager database 118. The wager data may include wager amount, odds, outcome, contextual information about the live event 102 and metadata from the wager such as the time taken to place the wager. The wager data may further include the result of the wager, such as whether the wager was won or lost and the payout or loss resulting from the wager. The saved data allows the automation detection module 122 to include the wager data in future determinations of whether automation is being used by the user's account. The base wagering module 120 adjusts, at step 322, the account balance of the user in the user database 110 based on the results of the wager. If the wager is won, then the account balance is increased in an amount equal to the payout. They payout is determined based upon the odds accepted when the user placed the wager. In the example the odds are 5/1 and the wager amount is $50, so the payout would be $250. If the wager amount was not debited from the account balance prior to play completion, then the account balance is adjusted by the difference between the wager amount and payout. Similarly, if the wager was lost and the wager amount was not previously debited from the account balance, the account balance is reduced by the wager amount. The base wagering module 120 polls, at step 324, the sensors 104 for whether the live event 102 is complete. If the live event 102 is not complete, the base wagering module 120 returns to step 304 and repeats the program. The program ends at step 326 if the live event 102 is complete.

FIG. 4 illustrates the automation detection module 122. The process begins with the automation detection module 122 receiving, at step 402, a prompt from the base wagering module 120 including at least one wager placed by a user. The wager includes an outcome, odds and wager amount and may also include the time taken to place the wager. Additionally, the automation detection module 122 receives contextual information about the current state of the live event 102 from the sensors 104. In this example, the live event 102 is an American football game and the contextual information may include, but is not limited to, any of the current down such as first, second, third or fourth, and the number of yards to a first down or goal, time left in the game, quarter, the score, the teams involved, the players on the field, the formation of the offense and defense, etc. The automation detection module 122 queries, at step 404, the historical wager database 118 for the user's historical wager data. The historical wager data may include any of wager amounts, odds, outcomes, context of the live event 102 such as the period during which the wager was placed, and metadata such as the time taken to place a wager. In the example, the automation detection module 122 retrieves all wager data from past wagers placed by the user Joe Smith. The automation detection module 122 selects, at step 406, a first parameter from the available parameters from the historical wager data. The parameter may include, but is not limited to, any of wager amount, odds, an outcome, contextual information from a live event 102 or additional metadata such as the amount of time taken to place a wager, etc. The amount of time taken to place a wager is the time elapsed from when the available wagers are displayed to the user and the wager is placed by the user. In this example, the selected parameter is the wager amount. The automation detection module 122 calculates, at step 408, a correlation coefficient for each pairing of the selected parameter and each unselected parameter. The correlation coefficient is a measure of the correlation between the selected parameter and a second parameter which can indicate the degree of influence of one parameter on the other. The closer a correlation coefficient is to 1, the stronger the implied influence. In the example, the correlation coefficient of wager amount and the time taken to place a wager is 0.96. The automation detection module 122 compares, at step 410, the correlation coefficients to a threshold value to determine whether automation is being used to place wagers. Automation is indicated if any correlation coefficient exceeds the threshold value as the parameters with a high correlation coefficient are likely being used by a program to place wagers. Lower correlation coefficients are expected from human users as humans are less precise or consistent than a computer program. The threshold value may be defined by the administrator of a wagering network 108 or may be determined by an algorithm. A higher threshold value will be less prone to false positives but may take longer to detect the use of automation, while a lower threshold value may identify some human activity as using automation. In the example, a user Joe Smith submitted a wager for $50 at odds of 5/1 that the New England Patriots will convert second and 8 for a first down. The wager being placed 0.21 seconds after available wagers were offered to the user Joe Smith. The automation detection module 122 retrieves the user Joe Smith's wager history from the historical wager database 118. Wager amount is selected as a first parameter and a correlation coefficient is calculated for wager amount and each remaining parameter for the user Joe Smith's past wagers during American football games. When comparing the correlation coefficients to a threshold value of 0.95, which was predefined by an administrator of the wagering network 108, the automation detection module 122 identifies the correlation coefficient of wager amount and time taken to place wagers as 0.96 which is greater than the threshold value of 0.95. The wager amount of $50 was so frequently wagered at 0.21 seconds after available wagers were offered, that it must be assumed that a robotic process is at work as humans are unlikely to wager with such consistent timing. It is therefore determined that automation has been used to place wagers for the user Joe Smith. It should be understood to those skilled in the arts that there are other methods of detecting automation in in-play betting, such as an extended winning streak that exceeds the likelihood of being done by a human. A robotic system may also build in systemic errors in order to hide the robotic process from the automation detection system. The automation detection module 122 checks, at step 412, if there are more parameters which have not been evaluated for correlation if none of the correlation coefficients for the previously selected parameter are greater than the threshold value. Each parameter should be evaluated for correlation with each other parameter, and if this condition is not met, then another parameter which has not been evaluated should be selected and the previous two steps repeated with the new selected parameter. In the example, if none of the correlation coefficients calculated for wager amount and each other parameter exceed the threshold value of 0.95, the automation detection module 122 identifies that at least the odds parameter has not been evaluated for correlation. the automation detection module 122 selects, at step 414, the next parameter which has not been evaluated for correlation. The next parameter is taken from the available parameters from the historical wager data. The automation detection module 122 further returns to step 408 to calculate correlation coefficients for each pairing of the now selected odds parameter and all unselected parameters. In the example, the automation detection module 122 selects the odds parameter, as it has not been evaluated for correlation and returns to step 408. The automation detection module 122 returns, at step 416, to the base wagering module 120 with whether automation was detected or not. In the example, automation was detected because the correlation coefficient of wager amount and time taken to place wagers was 0.96 which exceeded the 0.95 threshold value used to indicate the level of correlation expected from a program versus a human user.

In a further embodiment, if automation is detected, a notification may be displayed to the user that a current wager placed using automation is invalid, one or more previous wagers made by a user using automation have been invalidated, and/or that a user is prevented from making further wagers. Further, a user or an account could receive a displayed notification that an account associated with one or more automated wagers is locked and further action must be taken to reopen or reauthorize the account. Additionally, any notification regarding the invalidation of one or more wagers placed (or suspected of being placed) using automation, may be accompanied by a notification or listing of any related terms of service of the wagering app or wagering game and may indicate a violation of the terms of service.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A system of identifying use of an automated wagering system on a wagering system, the system comprising: a database that is configured to store a plurality of past wagers placed in the automated wagering system; a processor that is configured to: obtain two or more wager parameters of the plurality of past wagers stored in the database, perform a query on the plurality of past wagers in the database, filter the plurality of past wagers based on contextual information about a live event, calculate a first correlation coefficient for each parameter of the two or more wager parameters, wherein each calculated first correlation coefficient correlates to a history of using automation to place the plurality of past wagers and is based on a determination in real time that an amount of time taken to place a wager reflects a non-human process, compare each calculated first correlation coefficient to a threshold value, determine that automation is present after any first correlation coefficient exceeds the threshold value, wherein the determination that automation is present reflects detection of consistent timing of the plurality of past wagers, invalidating a placed wager in the wagering system, and locking an account in the wagering system associated with the placed wager.

2. The system of identifying use of the automated wagering system on the wagering system of claim 1, further comprising:

one or more additional correlation coefficients that are calculated if the first correlation coefficient is less than the threshold value.

3. The system of identifying use of the automated wagering system on the wagering system of claim 1, wherein the threshold value is 0.95.

4. The system of identifying use of the automated wagering system on the wagering system of claim 1, wherein the correlation coefficient is based on an amount of time from when the wager is available to be placed.

5. A method of displaying a determination of unauthorized wagering activity in a real time wagering system, the method comprising, executing on a processor: displaying a real time wagering game; displaying a wager which can be placed in real time; calculating a plurality of first correlation coefficients based on at least two wager parameters of the placed wager as compared to a plurality of past wagers in a database, wherein each calculated first correlation correlates to a history of using automation to place the plurality of past wagers and is based on a determination in real time that an amount of time taken to place a wager reflects a non-human process, and a determination that automation is present reflects detection of consistent timing of the plurality of past wagers; and displaying a notification that the placed wager is invalid based on contextual information and the two or more wager parameters of the placed wager after any first correlation coefficient exceeds a set threshold value; invalidating the placed wager in the wagering system; and locking an account in the wagering system associated with the placed wager.

6. The method of displaying the determination of unauthorized wagering activity in the real time wagering system of claim 5, further comprising:

displaying a notification that automation was used in the placement of at least one wager.

7. The method of displaying the determination of unauthorized wagering activity in the real time wagering system of claim 5, further comprising:

displaying a notification that an account associated with the placed wager is invalid.

8. The method of displaying the determination of unauthorized wagering activity in the real time wagering system of claim 5, further comprising:

displaying a notification that terms of service have been violated.

9. A system of identifying use of an automated wagering system on a wagering system, comprising: a database that is configured to store a plurality of past wagers placed in the automated wagering system; a processor that is configured to: perform a query on the plurality of past wagers stored in the database, filter the plurality of past wagers based on contextual information and two or more wager parameters of each placed wager, calculate a plurality of first correlation coefficients based on the two or more wager parameters of each placed wager as compared to the plurality of past wagers in the database, wherein each calculated first correlation correlates to a history of using automation to place the plurality of wagers and is based on a determination in real time that an amount of time taken to place a wager reflects a non-human process, and the determination reflects detection of consistent timing of the plurality of past wagers, compare each calculated first correlation coefficient to a threshold value, determine that automation was used after any first correlation coefficient exceeds the threshold value, invalidate the placed wager in the wagering system, and lock an account in the wagering system associated with the placed wager.

10. The system of identifying use of the automated wagering system on the wagering system of claim 9, further comprising one or more additional correlation coefficients that are calculated if the first correlation coefficient is less than the threshold value.

11. A method comprising: receiving, from a historical wager database, historical wager data; selecting parameters from the historical wager data; for each selected parameter, calculating a correlation coefficient by pairing the selected parameter to a respective unselected parameter, wherein each calculated correlation coefficient is a measure of a correlation between the selected parameter and the respective unselected parameter; comparing each correlation coefficient to a threshold value to determine whether automation has been used to place a plurality of past wagers based on a determination in real time that an amount of time taken to place a wager reflects a robotic process, and the determination reflects detection of consistent timing of the plurality of past wagers; and after any correlation coefficient exceeds the threshold value, displaying a notification related to the placed wager is invalid, invalidating the placed wager in a wagering system, and locking an account in the wagering system associated with the placed wager.

* * * * *